US009502199B2

(12) United States Patent
Naka et al.

(10) Patent No.: US 9,502,199 B2
(45) Date of Patent: Nov. 22, 2016

(54) ELECTROMAGNETIC CONTACTOR WITH SLIDING GUIDE

(71) Applicant: FUJI ELECTRIC FA COMPONENTS & SYSTEMS CO., LTD., Chuo-ku, Tokyo (JP)

(72) Inventors: Yasuhiro Naka, Kounosu (JP); Kouetsu Takaya, Kounosu (JP); Kenji Suzuki, Kounosu (JP)

(73) Assignee: FUJI ELECTRIC FA COMPONENTS & SYSTEMS CO., LTD., Tokyo (JP)

( * ) Notice: Subject to any disclaimer, the term of this patent is extended or adjusted under 35 U.S.C. 154(b) by 0 days.

(21) Appl. No.: 14/676,985

(22) Filed: Apr. 2, 2015

(65) Prior Publication Data

US 2015/0206685 A1 Jul. 23, 2015

Related U.S. Application Data

(63) Continuation of application No. PCT/JP2013/005738, filed on Sep. 26, 2013.

(30) Foreign Application Priority Data

Dec. 12, 2012 (JP) ..... 2012-271280

(51) Int. Cl.
*H01H 50/60* (2006.01)
*H01H 50/02* (2006.01)
(Continued)

(52) U.S. Cl.
CPC ..... *H01H 50/60* (2013.01); *H01H 50/02* (2013.01); *H01H 50/546* (2013.01); *H01H 51/2209* (2013.01)

(58) Field of Classification Search
CPC .... H01H 50/02; H01H 50/60; H01H 50/546; H01H 51/2209
See application file for complete search history.

(56) References Cited

U.S. PATENT DOCUMENTS 5,892,194 A 4/1999 Uotome et al.
7,157,995 B2 * 1/2007 Nishida ..... H01H 50/36 335/126

(Continued)

FOREIGN PATENT DOCUMENTS

JP 2012-243592 A 12/2012

OTHER PUBLICATIONS

PCT, "International Search Report for International Application No. PCT/JP2013/005738".

*Primary Examiner* — Bernard Rojas
(74) *Attorney, Agent, or Firm* — Manabu Kanesaka

(57) ABSTRACT

An electromagnetic contactor includes a pair of fixed contact portions having a predetermined distance from each other; a movable contact including a pair of movable contact portions disposed facing the pair of fixed contact portions; a movable support body supporting a central portion of the movable contact in an extending direction of the movable contact; a housing receptacle formed from a non-conductive body, housing at least the pair of fixed contact portions and the movable contact; an electromagnet unit causing the movable support body to move back and forth to cause the movable contact portions to contact to and separate from the fixed contact portions; and sliding guides extending along a moving direction of the movable contact for moving the movable contact back and forth in the housing receptacle to regulate a turning displacement of the movable contact. The sliding guides are different from the housing receptacle.

6 Claims, 11 Drawing Sheets

(51) Int. Cl.
*H01H 50/54* (2006.01)
*H01H 51/22* (2006.01)

(56) References Cited

U.S. PATENT DOCUMENTS 7,286,031 B2 * 10/2007 Nishida ..... H01H 9/02 335/128
2009/0066450 A1 * 3/2009 Yano ..... H01H 49/00 335/203
2009/0096559 A1 * 4/2009 Yano ..... H01H 9/443 335/187
2012/0092094 A1 * 4/2012 Lee ..... H01H 51/065 335/78
2013/0228552 A1 9/2013 Kashimura et al.

* cited by examiner

ELECTROMAGNETIC CONTACTOR WITH SLIDING GUIDE

CROSS-REFERENCES TO RELATED APPLICATIONS

The present application is a Continuation Application of International Application No. PCT/JP2013/005738 filed Sep. 26, 2013, and claims priority from Japanese Application No. 2012-271280 filed Dec. 12, 2012.

TECHNICAL FIELD

The present invention relates to an electromagnetic contactor with a sliding guide, that carries out an opening and closing of a current path by contacting and separating fixed contact portions and movable contact portions.

BACKGROUND ART

As a heretofore known electromagnetic contactor, there is, for example, an electromagnetic contactor described in PTL 1. This electromagnetic contactor is such that a pair of fixed contact portions and a movable contact are housed in a sealed receptacle formed of plastic, a ceramic, or the like. The movable contact extends in a direction facing the pair of fixed contact portions, a movable contact portion is formed on each of left and right free end portions of the movable contact, and the movable contact portions are disposed facing the fixed contact portions. Also, each of the fixed contact portions is provided on a free end of an individual fixed contact terminal formed in an approximate C-shape. Further, by a movable shaft being driven by an electromagnet unit, the left and right movable contact portions contact to and separate from the facing fixed contact portions. Because of this, opening and closing of a current path is possible.

CITATION LIST

Patent Literature

PTL 1: Japanese Patent No. 3,107,288

SUMMARY OF INVENTION

Technical Problem

When the movable shaft that supports a central portion of the movable contact moves back and forth in the axial direction, the movable contact is liable to oscillate in the direction of rotation around the axis of the movable shaft. When the movable contact is rotationally displaced, the opposing relationship between the movable contact portions and fixed contact portions deviates, which is not desirable. Normally, when the movable contact is turnably displaced, the oscillation of the movable contact is regulated by a width direction end surface of the movable contact contacting an internal structure formed in the sealed receptacle.

Herein, the movable contact is made of metal, while the sealed receptacle is formed of a ceramic or other insulating material.

Because of this, when the movable contact moves back and forth, sliding wear occurs between the movable contact and one portion of the sealed receptacle, and there is a possibility of wear debris being generated from the sealed receptacle. As the wear debris is an insulating material, in the event that the generated wear debris infiltrates between the contact portions, it will cause conduction failure.

The invention, having been contrived focusing on the heretofore described kind of point, has an object of providing an electromagnetic contactor such that the reliability of opening and closing a current path is increased.

Solution to Problem

In order to resolve the heretofore described problem, an electromagnetic contactor according to one aspect of the invention includes a pair of fixed contact portions, a movable contact including a pair of movable contact portions disposed facing the pair of fixed contact portions on two end portion sides thereof, and a shaft shaped movable support body supporting a central portion in an extending direction of the movable contact. Also, the electromagnetic contactor has a housing receptacle formed of a non-conductive body, housing at least the fixed contact portions and the movable contact. Also, an electromagnet unit drives the movable support body to move back and forth to cause the movable contact portions to contact to and separate from the fixed contact portions. Furthermore, the electromagnetic contactor includes sliding guides to regulate a turning displacement of the movable contact. The sliding guides are formed of parts different from the housing member.

Herein, the sliding guides may be made of metal.

At this time, the sliding guides may include two end portions in an extending direction of the sliding guide formed from a material having spring properties supported by the housing receptacle.

Also, it is good when the electromagnetic contactor includes at least four sliding guides. It is good when the four sliding guides form sets of two sliding guides, each being disposed sandwiching the movable contact on two sides of the movable contact in a width direction, a first set of sliding guides is positioned to one movable contact portion side than a portion linked to the movable support body, and a second set of sliding guides is positioned to the other movable contact portion side than the portion linked to the movable support body.

Also, the electromagnetic contactor may include a base plate portion integrally linking end portions of the sliding guides on the electromagnet unit side. Further, by disposing the base plate portion facing the outer surface side of a bottom portion on the electromagnet unit side of the housing receptacle, and inserting each of the sliding guides into each of the through apertures formed in the bottom portion respectively, each of the sliding guides may be disposed inside the housing receptacle.

At this time, it is good when the base plate portion is configured of two independent base plate portions, a first base plate portion is integrally linked to end portions of the first set of two sliding guides, and a second base plate portion is integrally linked to end portions of the second set of two sliding guides.

Also, the housing receptacle may be a receptacle configuring a sealed structure sealing at least the fixed contact portions and movable contact.

Advantageous Effects of Invention

According to one aspect of the invention, it is the metal sliding guides that slide when the movable contact moves back and forth. As metal is generally harder than resin, it is possible to suppress the generation of wear debris. Also, as any waste debris generated is conductive, it is possible to avoid conduction failure when the waste debris infiltrates between the contact portions. As a result of this, it is possible to increase the reliability of opening and closing a current path.

DESCRIPTION OF EMBODIMENTS

Figure 1:
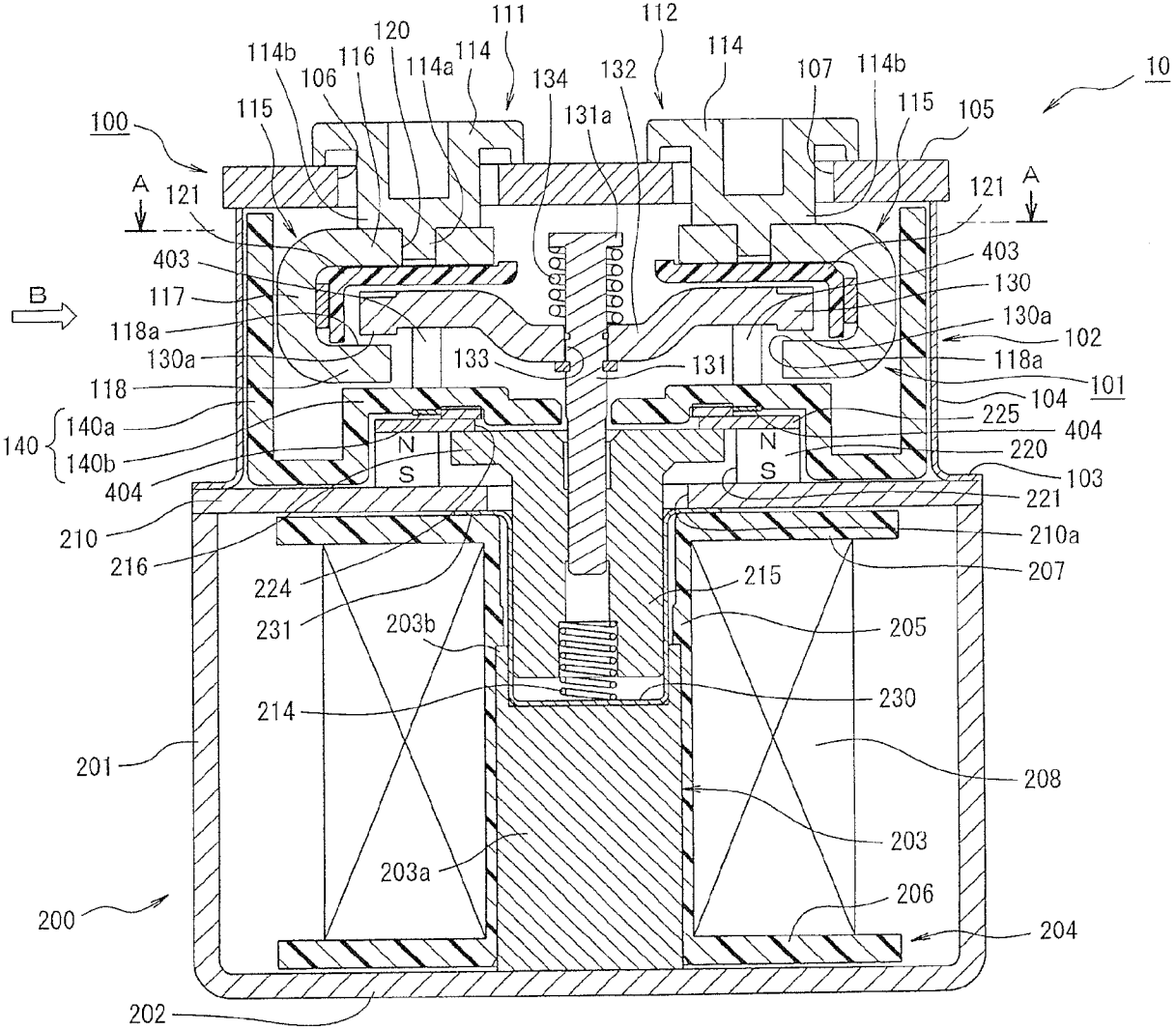
FIG. 1 is a sectional view showing an embodiment of an electromagnetic contactor according to the invention.

Hereafter, a description will be given, referring to the drawings, of an embodiment of the invention.

(Structure)

Figure 2B:
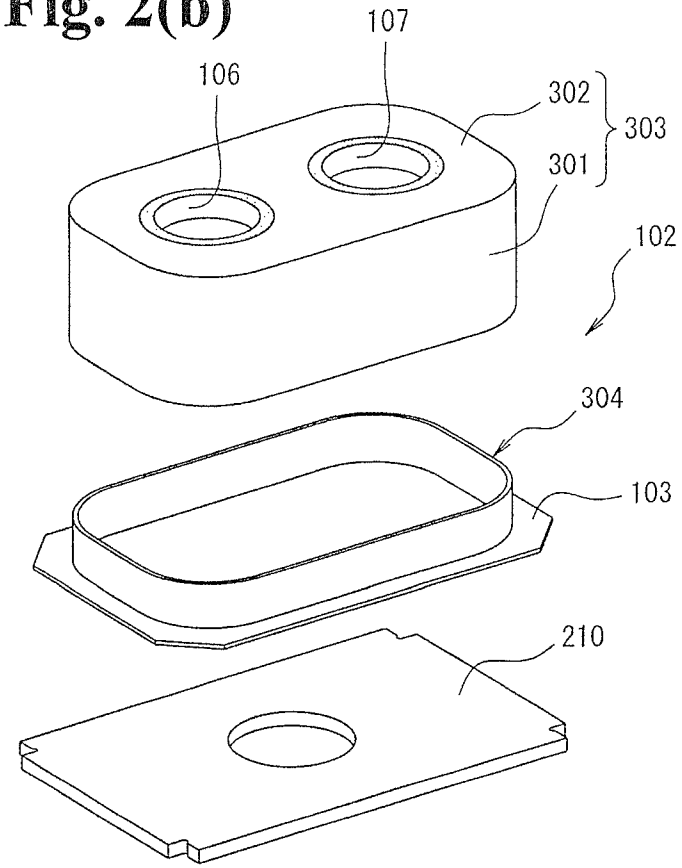
FIGS. 2(*a*), 2(*b*) are exploded perspective views of an arc extinguishing chamber.
Figure 2A:
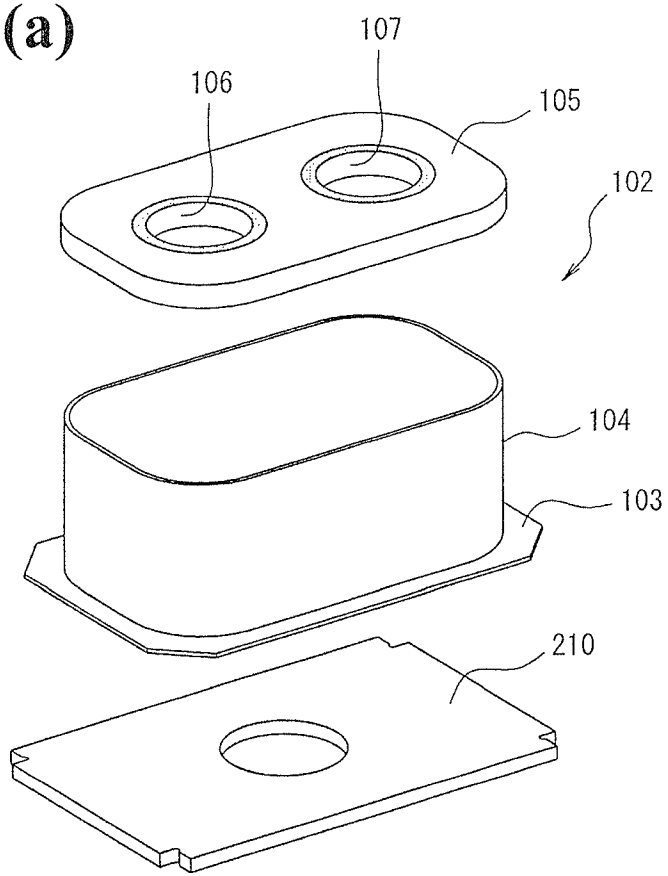

FIG. 1 is a sectional view showing an example of an electromagnetic contactor according to the invention, while FIGS. 2(*a*), 2(*b*) are exploded perspective views of an arc extinguishing chamber. In FIG. 1 and FIGS. 2(*a*), 2(*b*), reference sign 10 is an electromagnetic contactor, and the electromagnetic contactor 10 is configured of a contact device 100 in which is disposed a contact mechanism, and an electromagnet unit 200 that drives the contact device 100.

The contact device 100 has an arc extinguishing chamber 102 that houses a contact mechanism 101, as shown in FIG. 1 and FIGS. 2(*a*), 2(*b*). The arc extinguishing chamber 102 includes a metal rectangular tubular body 104, and a fixed contact support insulating substrate 105 including a plate-like ceramic insulating substrate that closes off the upper end of the metal rectangular tubular body 104, as shown in FIG. 2(*a*).

The metal rectangular tubular body 104 has on a metal lower end portion a flange portion 103 protruding outward. The metal rectangular tubular body 104 is formed such that the flange portion 103 thereof is seal joined and fixed to an upper portion magnetic yoke 210 of the electromagnet unit 200, to be described hereafter.

Also, through holes 106 and 107 in which is inserted a pair of fixed contacts 111 and 112, to be described hereafter, are formed maintaining a preset interval in a central portion of the fixed contact support insulating substrate 105. A metalizing process is performed around the through holes 106 and 107 on the upper surface side of the fixed contact support insulating substrate 105, and in a position on the lower surface side contacting the rectangular tubular body 104.

The contact mechanism 101, as shown in FIG. 1, includes the pair of fixed contacts 111 and 112 inserted into and fixed in the through holes 106 and 107 of the fixed contact support insulating substrate 105 of the arc extinguishing chamber 102. Each of the fixed contacts 111 and 112 includes a support conductor portion 114, having on an upper end a flange portion protruding outward, inserted into the through holes 106 and 107 of the fixed contact support insulating substrate 105, and a C-shaped portion 115, the inner side of which is opened, linked to the support conductor portion 114 and disposed on the lower surface side of the fixed contact support insulating substrate 105.

The C-shaped portion 115 has a fixed contact attachment portion 116 extending to the outer side along the line of the lower surface of the fixed contact support insulating substrate 105, an intermediate portion 117 extending downward from the outer side end portion of the fixed contact attachment portion 116, and a contact formation portion 118 extending from the lower end side of the intermediate portion 117, parallel with the fixed contact attachment portion 116, to the inner side, that is, in a direction facing the fixed contacts 111 and 112. In this way, the C-shaped portion 115 is formed in a C-shape wherein the fixed contact attachment portion 116 is added to an L-shape formed by the intermediate portion 117 and contact formation portion 118.

Also, as is clear from FIG. 1, the fixed contact attachment portion 116 is disposed jutting further than the fixed contact support insulating substrate 105 to a movable contact portion 130 side.

Herein, a pin 114*a* formed protruding on the lower end surface of the support conductor portion 114 is inserted into a through hole 120 formed in the fixed contact attachment portion 116 of the C-shaped portion 115. In this state, the support conductor portion 114 and C-shaped portion 115 are fixed by, for example, brazing. The fixing of the support conductor portion 114 and C-shaped portion 115, not being limited to brazing, may be formed such that the pin 114*a* is fitted into the through hole 120, or an external thread is formed on the pin 114*a* and an internal thread formed in the through hole 120, and the two are screwed together.

Furthermore, an insulating cover 121 is provided covering the fixed contact attachment portion 116 and intermediate portion 117 of the C-shaped portion 115 of the fixed contacts 111 and 112. The insulating cover 121, being made of a synthetic resin material, is a member that regulates arc generation with respect to the fixed contact attachment portion 116 and intermediate portion 117.

Figure 3:
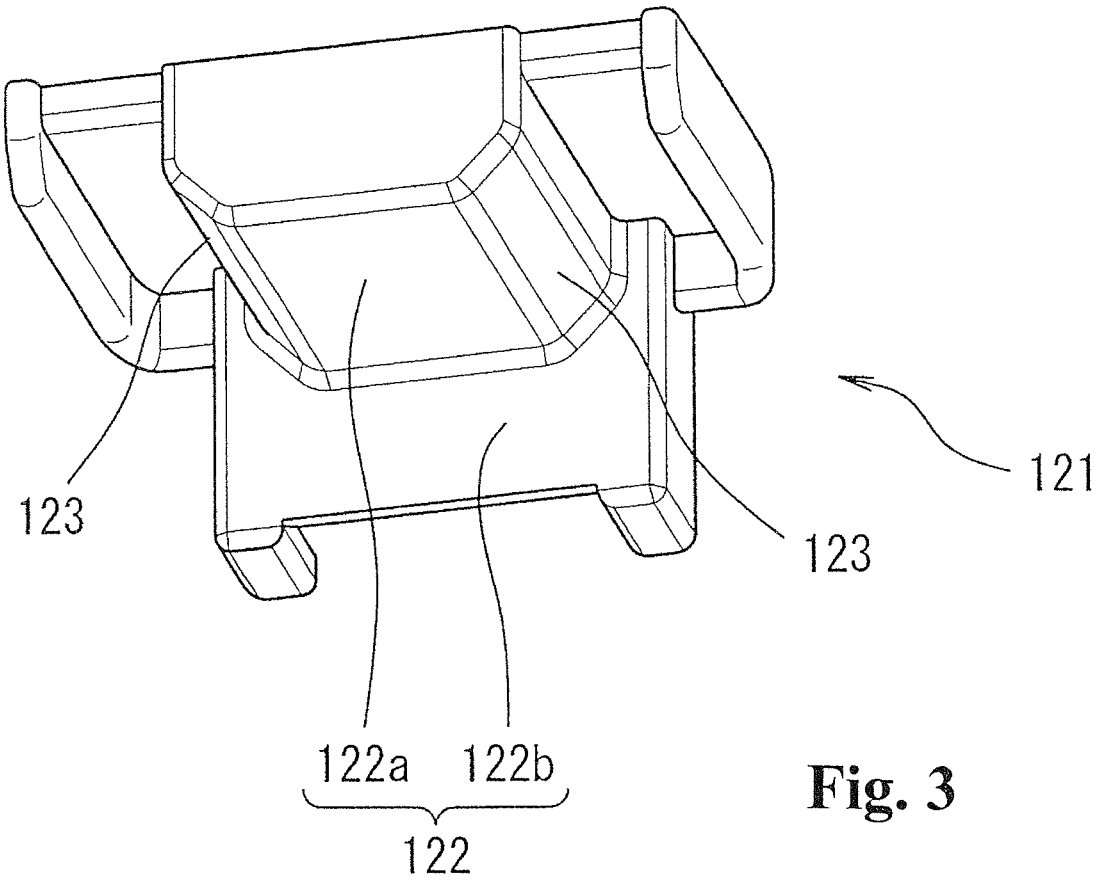
FIG. 3 is a perspective view showing an insulating cover of a contact device viewed from below.

The insulating cover 121 covers the inner peripheral surfaces of the fixed contact attachment portion 116 and intermediate portion 117 of the C-shaped portion 115. As shown in FIG. 3, the insulating cover 121 includes an L-shaped plate portion 122 that follows the inner peripheral surfaces of the fixed contact attachment portion 116 and intermediate portion 117, upright portions 123 extending upward and outward from each of front and back end portions of the L-shaped plate portion 122 and covering side surfaces of the fixed contact attachment portion 116 and intermediate portion 117 of the C-shaped portion 115, and fitting portions (not shown), formed inward from the upper ends of the upright portions 123, that fit into a small diameter portion 114*b* formed in the support conductor portions 114 of the fixed contacts 111 and 112.

Because of the insulating cover 121, only the upper surface side of the contact formation portion 118 is exposed on the inner peripheral surface of the C-shaped portion 115, and is taken to be a contact portion 118*a*.

Herein, the L-shaped plate portion 122 is formed of an upper cover portion 122*a* facing the fixed contact attachment portion 116 and a side cover portion 122*b* facing the intermediate portion 117.

Figure 4:
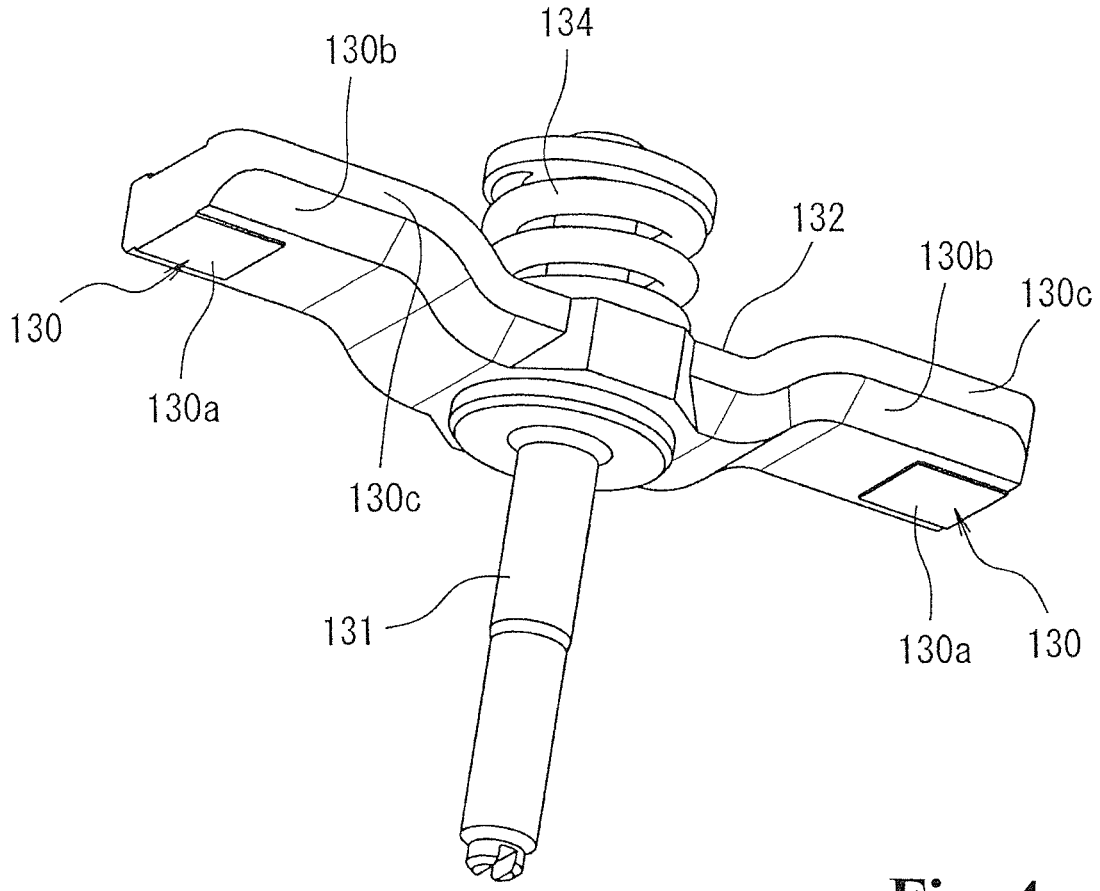
FIG. 4 is a diagram showing the relationship between a C-shaped portion and the insulating cover, viewed from a direction B of FIG. 1.

Furthermore, left and right movable contact portions 130 are disposed in the C-shaped portion 115 of the fixed contacts 111 and 112. Specifically, a metal movable contact 132 is included extending in the direction in which the left and right fixed contacts 111 and 112 are separated. The movable contact portions 130 are formed on both left and right end portions of the movable contact 132, and each of the movable contact portions 130 is disposed in the C-shaped portion 115. The movable contact 132 is supported by a movable support body 131 formed of a shaft body fixed to a movable iron core 215 of the electromagnet unit 200, to be described hereafter. The movable contact 132 is formed such that a depressed portion protruding downward is formed in the vicinity of the movable support body 131 positioned in a central portion, and a through hole 133 through which the movable support body 131 is inserted is formed in the depressed portion, as shown in FIG. 1 and FIG. 4. A flange portion 131*a* protruding outward is formed on the upper end of the movable support body 131. The movable support body 131 is inserted from the lower end side through a contact spring 134, then inserted through the through hole 133 of the movable contact 132, bringing the upper end of the contact spring 134 to contact the flange portion 131*a*. Further, the movable contact 132 is positioned using, for example, a C-ring 135 so as to obtain a preset urging force from the contact spring 134.

The movable contact portions 130, in a released state, become a state wherein contact portions 130*a* at either end and the contact portions 118*a* of the contact formation portions 118 of the C-shaped portions 115 of the fixed contacts 111 and 112 are separated from each other to maintain a preset interval, as shown in FIG. 1. Also, the movable contact portions 130 are set so that, in an engaged position, the contact portions at either end contact the contact portions 118*a* of the contact formation portions 118 of the C-shaped portions 115 of the fixed contacts 111 and 112 at a preset contact pressure from the contact spring 134.

Furthermore, a non-conductive housing receptacle is disposed on the inner peripheral surface of the rectangular tubular body 104 of the arc extinguishing chamber 102. In the embodiment, the housing receptacle is exemplified by a case of being configured of the kind of synthetic resin insulating cylinder 140 shown in FIG. 5.

The insulating cylinder 140 includes a rectangular tubular portion 140*a* disposed on the inner peripheral surface of the rectangular tubular body 104 and a bottom plate portion 140*b* that closes off the lower surface side of the rectangular tubular portion 140*a*, as shown in FIG. 1. The fixed contact support insulating substrate 105 forms a top plate portion of the housing receptacle.

Figure 5:
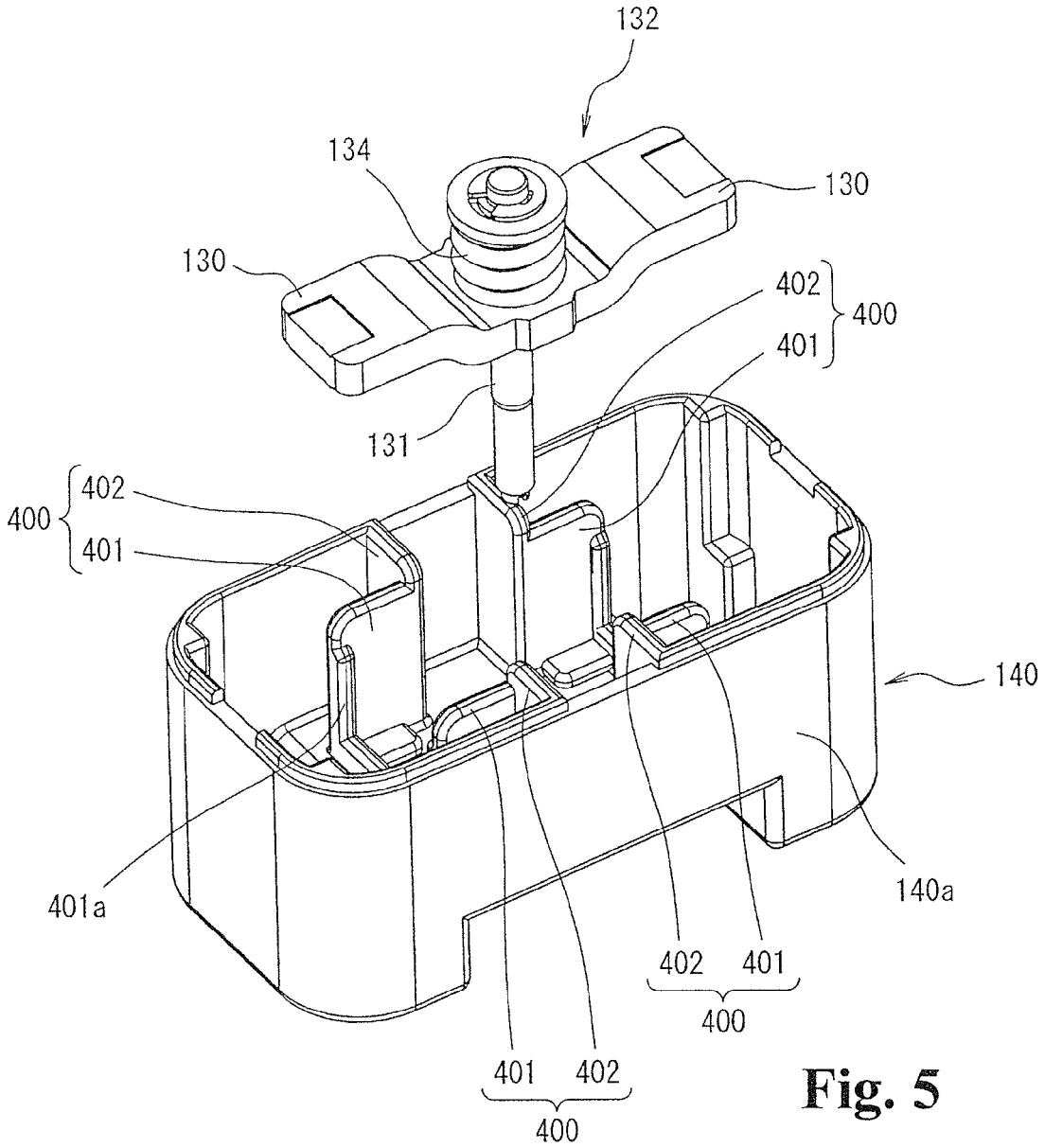
FIG. 5 is a perspective view showing the relationship between an insulating cylinder and a movable contact.
Figure 6:
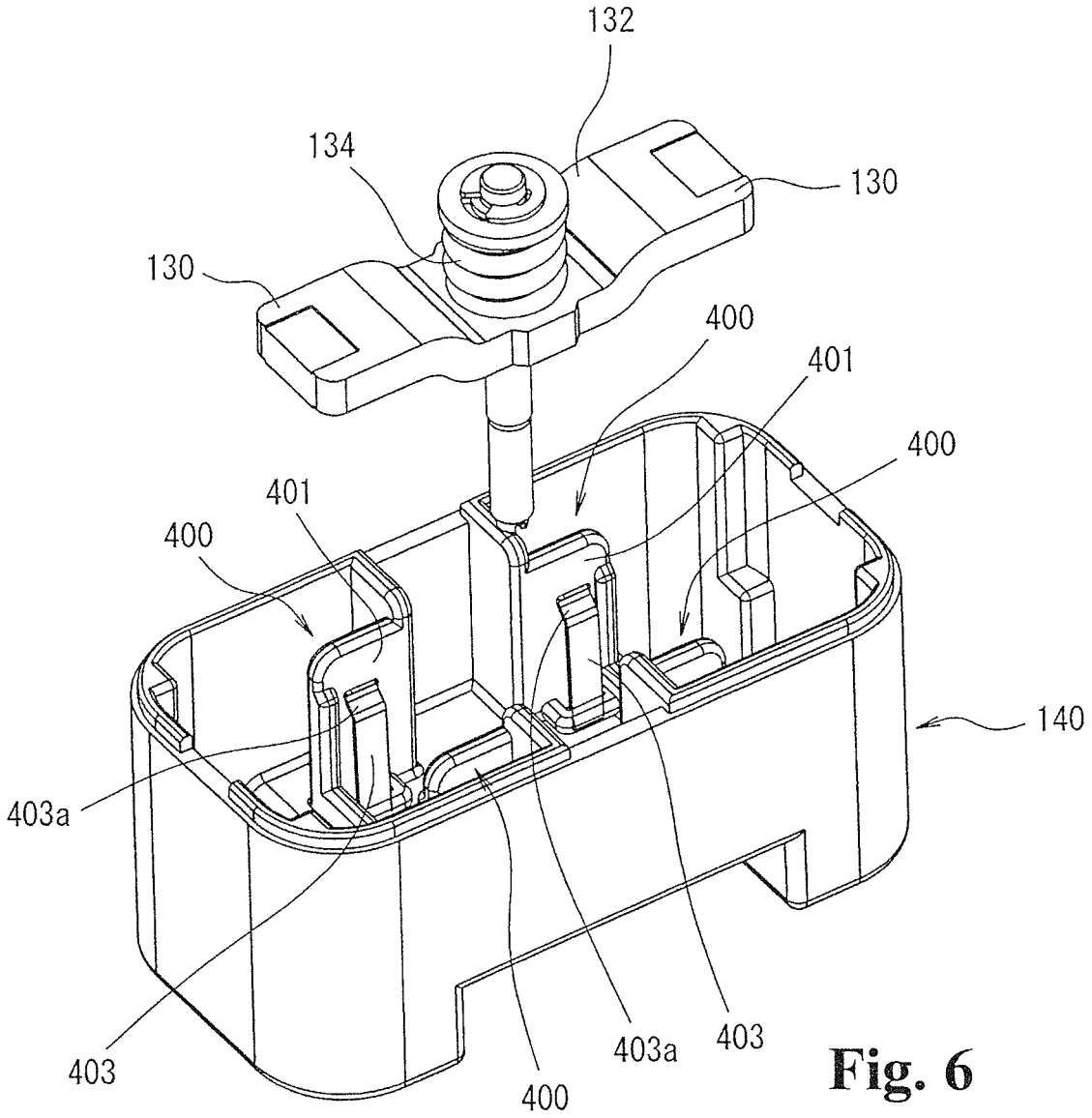
FIG. 6 is a perspective view showing a state wherein sliding guides are installed in the insulating cylinder.

Two sets of wall portions 400, each facing each other in the lateral direction of the insulating cylinder 140 (the direction perpendicular to the extension direction of the movable contact 132), are formed in the interior of the insulating cylinder 140, as shown in FIG. 5 and FIG. 6. That is, four wall portions 400 are formed in the insulating cylinder 140.

A first set of wall portions 400 and second set of wall portions 400 are disposed symmetrically in the longitudinal direction of the insulating cylinder 140. Each wall portion 400, which is a wall body with an L-shaped transverse section, has an opposing wall portion 401 of which a lower end portion is integrally linked to the bottom plate portion 140*b* and which faces the movable contact 132. The distance between the facing wall portions 401 of wall portions 400 forming a set in the lateral direction is set to be slightly greater than the width of the movable contact 132. A guide portion 401*a* is formed on an end portion of each opposing wall portion 401. Each guide portion 401*a* is formed so as to extend in an up-down direction in a state protruding to the movable contact 132 side. Further, it comes to a state such that the movable contact 132 is disposed between each facing set of wall portions 400. Because of this, oscillation in the direction of rotation of the movable contact 132 is kept small by the opposing wall portions 401.

Furthermore, a sliding guide 403 is disposed between the opposing wall portion 401 and movable contact 132 on the front side of each opposing wall portion 401, as shown in FIG. 6, which is an exploded view. Specifically, the sliding guide 403 is disposed in a position further to the center than the end portion side guide portion 401*a*. Each sliding guide 403 includes a metal plate extending in an up-down direction, which is the direction in which the movable contact 132 moves back and forth. As heretofore described, the insulating cylinder 140 has the four sliding guides 403 along the opposing wall portions 401.

Figure 7:
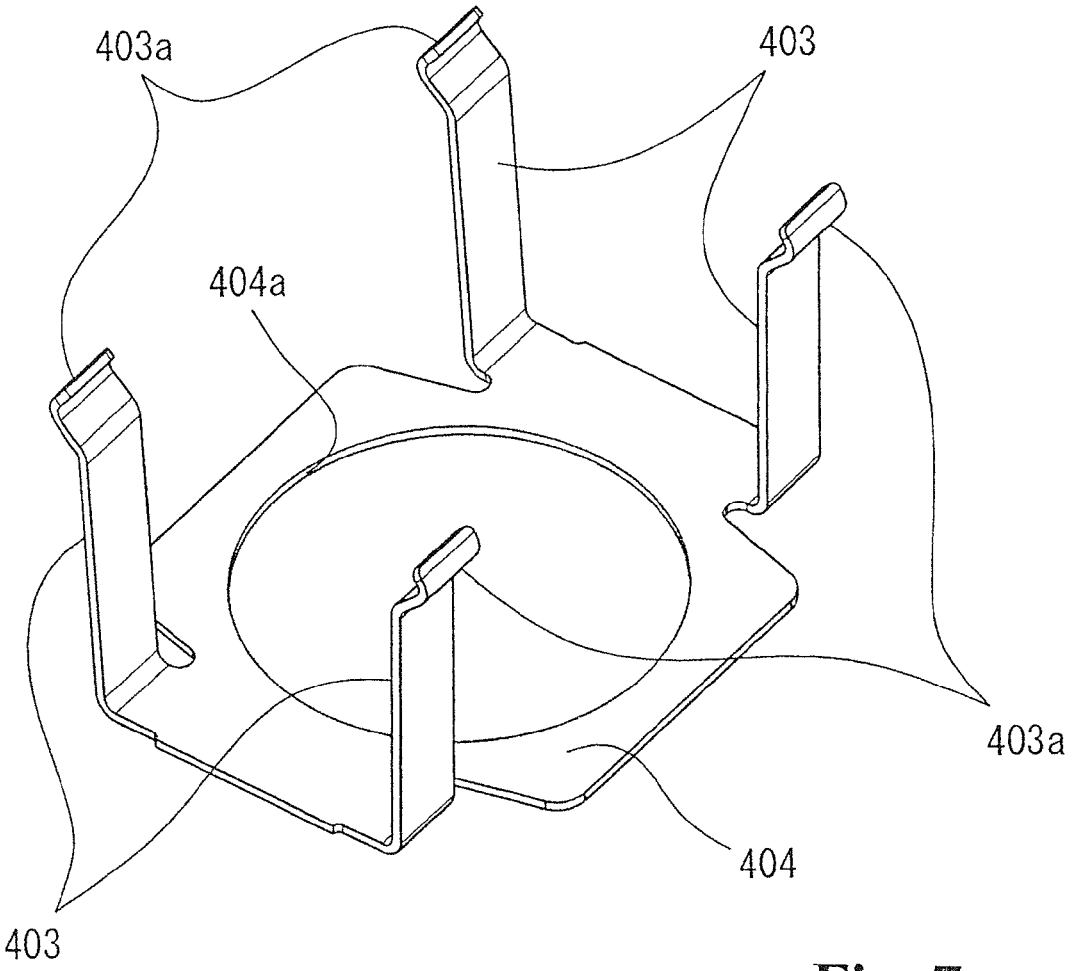
FIG. 7 is a perspective view showing the sliding guides and a base plate portion.

The four sliding guides 403 are formed such that lower end portions are integrally linked to one base plate portion 404, as shown in FIG. 7. That is, the four sliding guides 403 and the base plate portion 404 are formed by one metal plate formed by a punching process and other processes, after which the lower end portions of the sliding guides 403 are bent less than 90 degrees upward. By so doing, the four sliding guides 403 are erected in a leg form facing upward from the base plate portion 404. A large aperture 404*a* is formed in a central portion of the base plate portion 404. Also, an upper end portion of each sliding guide 403 is bent to the opposing wall portion 401 side, forming a contact portion 403*a* for the relevant opposing wall portion 401. Herein, processing is carried out so that the amount of bending of each sliding guide 403 with respect to the base plate portion 404 is less than 90 degrees (the amount of bending is such that the sliding guides 403 are spread slightly outward).

Figure 8:
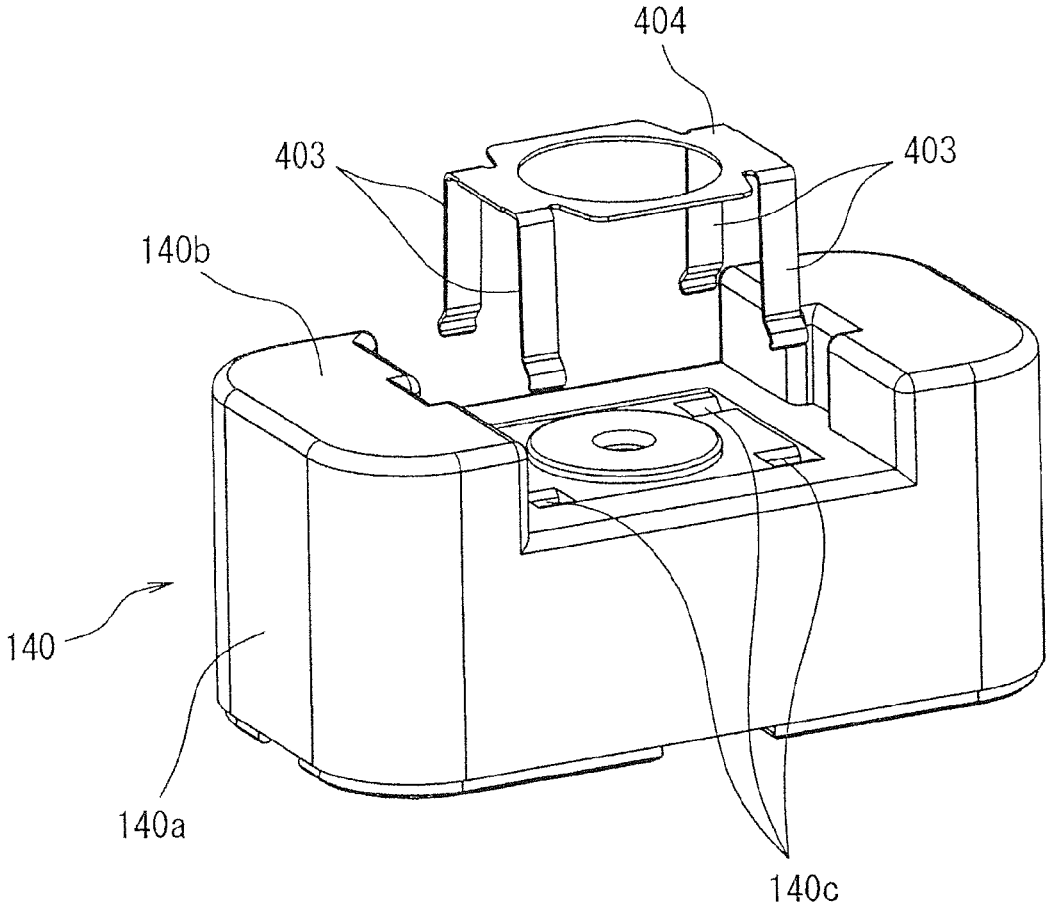
FIG. 8 is a diagram illustrating the installation of the sliding guides in the insulating cylinder.

Further, apertures 140*c* through which the sliding guides 403 can be inserted are formed in four places in a central portion of the bottom plate portion 140*b* of the insulating cylinder 140, as shown in the vertically reversed FIG. 8, and the sliding guides 403 are disposed as heretofore described by the sliding guides 403 being inserted into the apertures, respectively.

By the base plate portion 404 contacting the outer surface of the bottom plate portion 140*b* at this time, it comes to a state such that the lower end portion of each sliding guide 403 is supported by the insulating cylinder 140. Also, as the bending of the sliding guides 403 is less than 90 degrees, the sliding guides 403 inserted inside the insulating cylinder 140 attempt to spread outward, and the contact portions 403*a*, which are the leading end portions of the sliding guides 403, are pressed against the opposing wall portions 401. That is, by the contact portions 403*a* of the sliding guides 403 contacting against the opposing wall portions 401, the contact portions 403*a* are supported in a state wherein they are positioned by the opposing wall portions 401. As a result of this, both end portions of each sliding guide 403 portion are supported by the insulating cylinder 140, while a portion between the two end portions comes to a suspended state. It is preferable that the sliding guides are made of a metal having spring properties.

Figure 9:
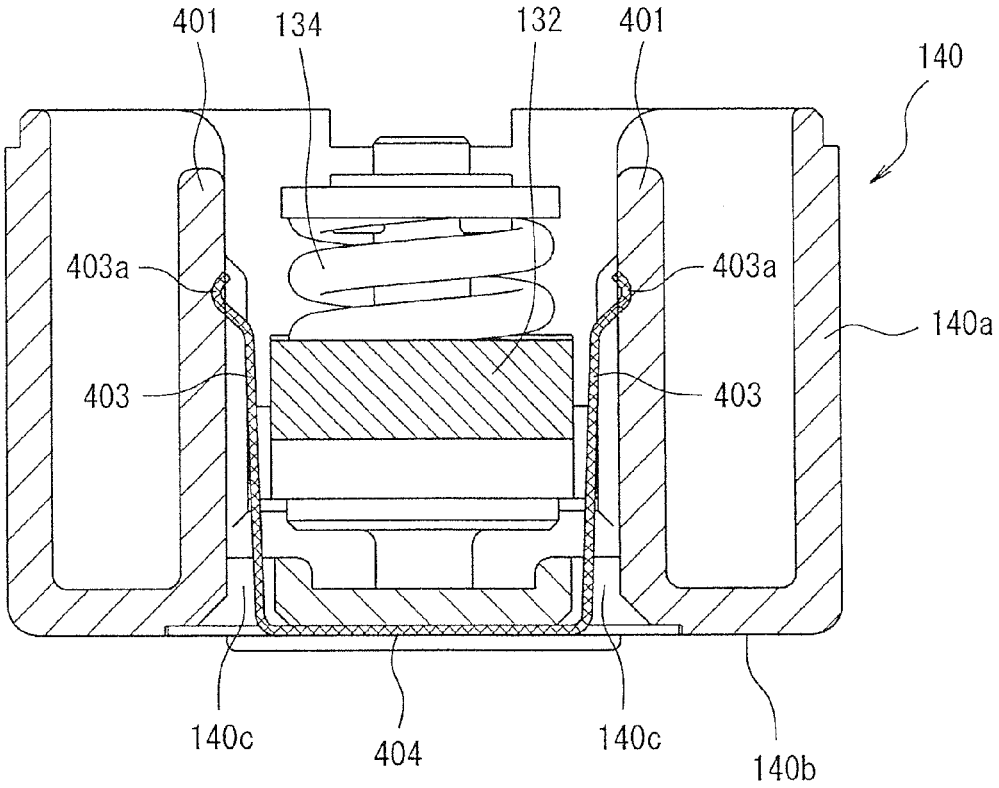
FIG. 9 is a sectional view showing a state wherein the sliding guides are installed in the insulating cylinder.

FIG. 9 is a sectional view showing an inserted state.

The electromagnet unit 200, as shown in FIG. 1, includes the movable iron core 215, of which one end portion side is linked to the movable support body 131 and whose axis faces a direction following the drive direction of the movable support body 131, a fixed iron core 203, disposed coaxially with the movable iron core 215 on the other axial direction end portion side of the movable iron core 215, extending in a direction away from the movable iron core 215, and an exciting coil 208 disposed on at least the outer peripheral side of the fixed iron core 203. Also, the electromagnet unit 200 has a magnetic yoke 201 of a flattened U-shape when viewed from the side, as shown in FIG. 1.

The fixed iron core 203 is disposed in an upright state in a central portion of a bottom plate portion 202 of the magnetic yoke 201. The fixed iron core 203 is formed of a columnar fixed iron core main body 203*a* and a bottomed depressed portion 203*b* of a bottomed tubular form, formed in an upper portion of the fixed iron core main body 203*a* and opened upward. The fixed iron core main body 203*a* extends upward in a state wherein the lower end surface is contacting the upper surface in a central portion of the bottom plate portion 202 of the magnetic yoke 201. The depressed portion 203*b* with a bottom in the tubular form is made such that a lower end portion of the movable iron core 215 can be inserted therein.

A spool 204 is disposed as a plunger drive portion on the outer side of the fixed iron core 203. The spool 204 includes a central cylinder portion 205 in which the fixed iron core 203 is inserted, a lower flange portion 206 protruding outward in a radial direction from a lower end portion of the central cylinder portion 205, and an upper flange portion 207 protruding outward in a radial direction from the upper end of the central cylinder portion 205. Further, the exciting coil 208 is wound and mounted in a housing space including the central cylinder portion 205, lower flange portion 206, and upper flange portion 207.

Further, the upper magnetic yoke 210 is fixed between upper ends forming an opened end of the magnetic yoke 201. A through hole 210*a* facing the central cylinder portion 205 of the spool 204 is formed in a central portion of the upper magnetic yoke 210.

Further, the movable iron core 215 is disposed in a position in an upper portion of the central cylinder portion 205 of the spool 204 so as to be able to slide up and down. An upper portion of a return spring 214 is simultaneously attached to the lower end surface of the movable iron core 215. A peripheral flange portion 216 protruding outward in a radial direction is formed on the movable iron core 215, in a position on an upper end portion protruding upward from the upper magnetic yoke 210.

Also, a permanent magnet 220 formed in a ring-form is fixed to the upper surface of the upper magnetic yoke 210. The permanent magnet 220 is disposed so as to enclose the peripheral flange portion 216 of the movable iron core 215. The permanent magnet 220 has a through hole 221 enclosing the peripheral flange portion 216. The permanent magnet 220 is magnetized in an up-down direction, that is, a thickness direction, so that the upper end side is, for example, an N-pole while the lower end side is an S-pole. The form of the through hole 221 of the permanent magnet 220 is a form tailored to the form of the peripheral flange portion 216, while the form of the outer peripheral surface can be an arbitrary form such as circular or rectangular.

Further, an auxiliary yoke 225 of the same external form as the permanent magnet 220, and having a through hole 224 with an inner diameter smaller than the outer diameter of the peripheral flange portion 216 of the movable iron core 215, is fixed to the upper end surface of the permanent magnet 220. The peripheral flange portion 216 of the movable iron core 215 is arranged to face the lower surface of the auxiliary yoke 225.

Also, the movable support body 131 that supports the movable contact portions 130 is screwed to the upper end surface of the movable iron core 215.

Further, in a released state, the movable iron core 215 is urged upward by the return spring 214, and the upper surface of the peripheral flange portion 216 attains a released position wherein it contacts the lower surface of the auxiliary yoke 225. In this state, the contact portions 130*a* of the movable contact portions 130 have moved away upward from the contact portions 118*a* of the fixed contacts 111 and 112, causing a state wherein current is interrupted.

In the released state, the peripheral flange portion 216 of the movable iron core 215 is suctioned to the auxiliary yoke 225 by the magnetic force of the permanent magnet 220, and by a combination of this magnetic force and the urging force of the return spring 214, the state in which the movable iron core 215 contacts the auxiliary yoke 225 is maintained, with no unplanned downward movement due to vibration, shock, or the like, from the exterior.

Further, at least the lower end portion side of the movable iron core 215 is covered with a cap 230, formed in a bottomed tubular form, made of a non-magnetic body and opened upward.

The bottom portion side of the cap 230 is inserted so as to fit inside the bottomed depressed portion 203*b* of the fixed iron core 203. By so doing, the bottom end portion side of the movable iron core 215 attains a state wherein it is in proximity to the interior of the bottomed depressed portion 203*b* of the fixed iron core 203 through the cap as shown in FIG. 1.

Also, a flange portion 231 formed extending outward in a radial direction on an opened end of the cap 230 is seal joined to the lower surface of the upper magnetic yoke 210. By so doing, a hermetic receptacle (sealed structure), wherein the arc extinguishing chamber 102 and cap 230 are in communication via the through hole 210*a* of the upper magnetic yoke 210, is formed. Further, a gas such as hydrogen gas, nitrogen gas, a mixed gas of hydrogen and nitrogen, air, or $SF_6$ is encapsulated inside the hermetic receptacle formed by the arc extinguishing chamber 102 and cap 230. Because of this, the movable iron core 215 is positioned inside the hermetic receptacle.

A description has been given of a case in which a hermetic receptacle is made by the arc extinguishing chamber 102 and cap 230, and gas is encapsulated inside the hermetic receptacle, but not being limiting to this, the gas encapsulation may be omitted when the interrupted current is small.

(Operation)

Next, a description will be given of an operation of the electromagnetic contactor of the heretofore described embodiment.

Herein, it is assumed that the fixed contact 111 is connected to, for example, a power supply source that supplies a large current, while the fixed contact 112 is connected to a load.

In this state, the exciting coil 208 in the electromagnet unit 200 is in a non-exciting state, and there exists a released state wherein no exciting force causing the movable iron core 215 to descend is being generated in the electromagnet unit 200. In this released state, the movable iron core 215 is urged in an upward direction away from the upper magnetic yoke 210 by the return spring 214. Simultaneously with this, a suctioning force created by the magnetic force of the permanent magnet 220 acts on the auxiliary yoke 225, and the peripheral flange portion 216 of the movable iron core 215 is suctioned. Because of this, the upper surface of the peripheral flange portion 216 of the movable iron core 215 contacts the lower surface of the auxiliary yoke 225.

Because of this, the contact portions 130*a* of the contact mechanism 101 of the movable contact portions 130 linked to the movable iron core 215 via the movable support body 131 are separated by a preset distance upward from the contact portions 118*a* of the fixed contacts 111 and 112. Because of this, the current path between the fixed contacts 111 and 112 is in an interrupted state, and the contact mechanism 101 is in an opened contact state.

In this way, as the urging force of the return spring 214 and the suctioning force of the annular permanent magnet 220 both act on the movable iron core 215 in the released state, there is no unplanned downward movement of the movable iron core 215 due to vibration, shock, or the like, from the exterior, and it is thus possible to reliably prevent malfunction.

On the exciting coil 208 of the electromagnet unit 200 being excited in the released state, an exciting force is generated in the electromagnet unit 200, and the movable iron core 215 is pressed downward against the urging force of the return spring 214 and the suctioning force of the annular permanent magnet 220.

By the movable iron core 215 descending in this way, the movable contact portions 130 linked to the movable iron core 215 via the movable support body 131 also descend, and the contact portions 130*a* thereof contact the contact portions 118*a* of the fixed contacts 111 and 112 with the contact pressure of the contact spring 134.

Because of this, there exists a closed contact state wherein the large current of the external power supply source is supplied via the fixed contact 111, movable contact portion 130, and fixed contact 112 to the load.

When interrupting the supply of current to the load in the closed contact state of the contact mechanism 101, the exciting of the exciting coil 208 of the electromagnet unit 200 is stopped.

Because of this, there is no longer an exciting force causing the movable iron core 215 to move downward in the electromagnet unit 200. Consequently, the movable iron core 215 is raised by the urging force of the return spring 214, and the suctioning force of the annular permanent magnet 220 increases as the peripheral flange portion 216 approaches the auxiliary yoke 225.

By the movable iron core 215 rising, the movable contact portions 130 linked via the movable support body 131 rise. As a result of this, the movable contact portions 130 are contacting the fixed contacts 111 and 112 for as long as contact pressure is applied by the contact spring 134. Subsequently, there starts an opened contact state, wherein the movable contact portions 130 move upward away from the fixed contacts 111 and 112 at the point at which the contact pressure of the contact spring 134 stops.

Modification Examples

Figure 10:
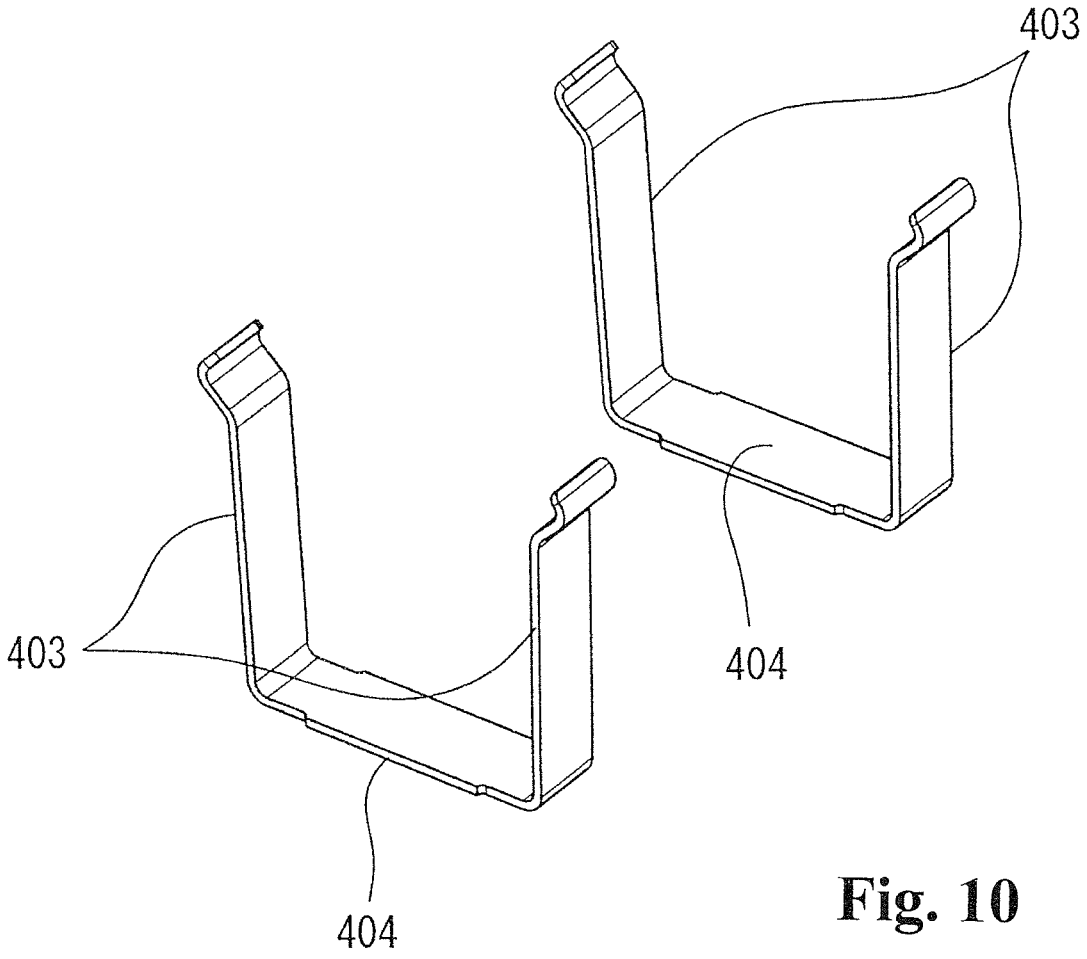
FIG. 10 is a perspective view showing another example of sliding guides and a base plate portion.

Heretofore, a description has been given of a case wherein four sliding guides 403 are linked to one base plate portion 404. The invention is not limited to this. For example, individual base plate portions 404 for two sliding guides 403 may be prepared respectively, and the sliding guides 403 are linked to the base plate portions, as shown in FIG. 10.

Figure 11:
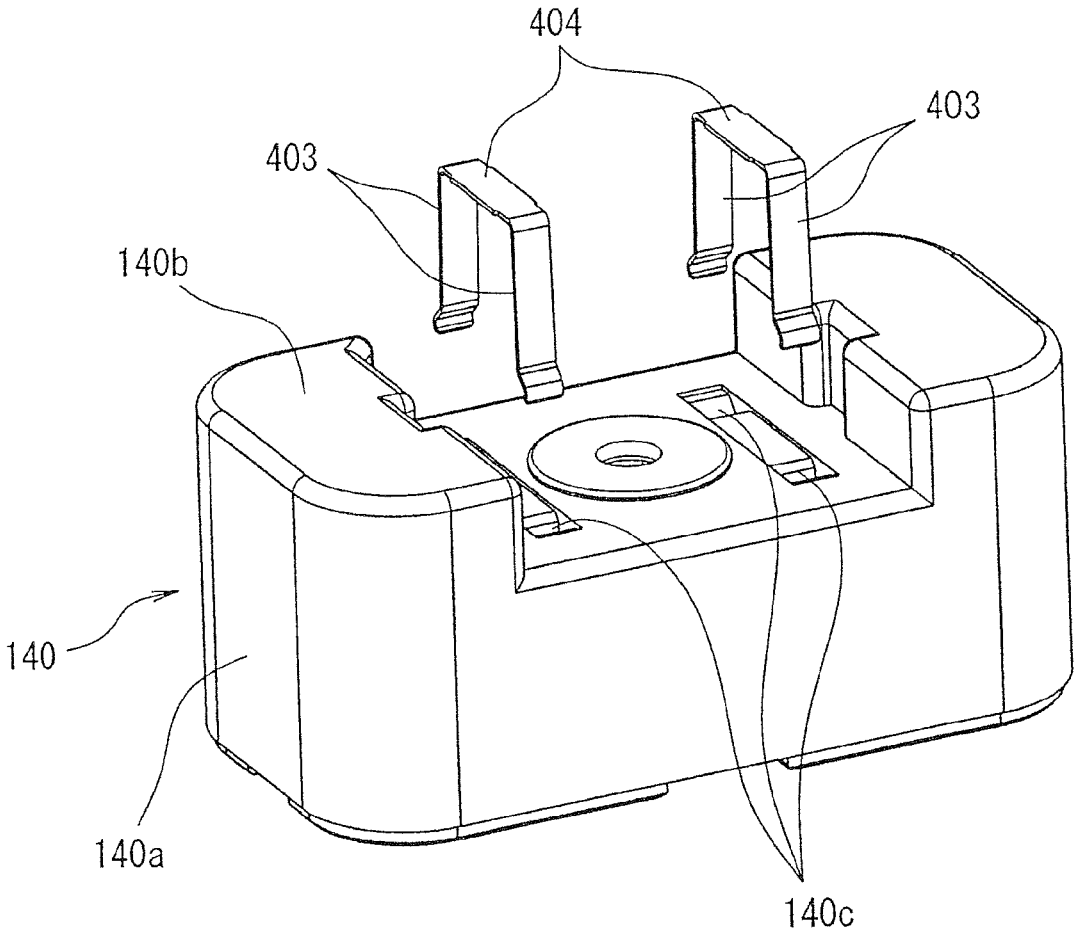
FIG. 11 is a diagram illustrating the installation of the sliding guides in the insulating cylinder.

In this case, it is sufficient that the sliding guides 403 are installed two at a time in the insulating cylinder 140, as shown in FIG. 11. As the state of the sliding guides 403 after installation is the same as that shown in FIG. 9, the same operational advantages can be obtained.

Also, it is not absolutely necessary that the sliding guides 403 are made of metal. The sliding guides 403 may be formed of a low friction material having conductivity.

When the sliding guides 403 is formed of a low friction material, an advantage is obtained in that it is possible to reduce wear debris. Herein, it is preferable that the material of the sliding guides 403 has conductivity.

Advantages of Embodiment

The following kinds of advantage are obtained with the electromagnetic contactor 10 of the embodiment.

(1) The metal sliding guides 403, which extend in the direction in which the movable contact 132 moves back and forth and regulate the turning displacement of the movable contact 132, are provided inside the insulating cylinder 140.

It is preferable that there are two or more sliding guides 403.

According to this configuration, the following advantages are obtained.

When the movable contact 132 moves back and forth (performs a stroke operation) in order to contact or separate the fixed contact portions and movable contact portions, the movable contact 132 performs the stroke operation while oscillating in the direction of rotation, with the movable support body 131 as an axis. At this time, when the movable contact 132 attempts to oscillate in the direction of rotation, the width direction end surface portions of the movable contact 132 contact the metal sliding guides 403. Because of this, the movable contact 132 performs the stroke operation while the amount of oscillation in the direction of rotation is regulated by the sliding guide 403 portions. That is, when the movable contact 132 performs a stroke operation in the direction in which it moves back and forth, the movable contact 132 performs the stroke operation while partially sliding against the metal sliding guides 403.

At this time, the sliding guides 403 are made of metal. That is, as the sliding guides 403 has greater hardness than the insulating cylinder 140, it is possible to reduce the generation of wear debris in comparison with the case when the movable contact 132 performs a stroke operation while sliding against the insulating cylinder 140.

Furthermore, even in the event that wear debris is generated from the sliding guides 430, and the wear debris infiltrates between the contact portions, the wear debris is conductive, because of which it is possible to avoid conduction failure. As a result of this, it is possible to increase the reliability of opening and closing the current path.

(2) The sliding guides 403 are formed of a material having spring properties, wherein both end portions in the extension direction thereof are supported in a housing receptacle. A spring steel plate can be given as an example of a material having spring properties.

According to this configuration, in the sliding guides 403, the portion that slides against the movable contact 132 comes to a suspended state to be deflectable. Because of this, when the movable contact 132 contacts the sliding guides 403, the movable contact 132 is provided with the elastic force for returning to an initial position, and it is thus easy for the movable contact 132 to return to the initial position.

Herein, by the bending of the base plate portion 404 and sliding guides 403 being less than 90 degrees, it keeps a state such that the leading end portions of the sliding guides 403 are pressed against the opposing wall portions 401. Because of this, oscillation of the sliding guides 403 caused by the movable contact 132 sliding against the sliding guides 403 is suppressed. Also, by the leading end portions (contact portions 403*a*) of the sliding guides 403 being pressed against the opposing wall portions 401 as heretofore described, it is possible to easily position the sliding guides 403.

(3) At least four sliding guides 403 are prepared, the four sliding guides 403 form sets of two sliding guides 403 each being disposed to sandwich the movable contact 132 on either width direction side of the movable contact 132, a first set of sliding guides 403 is positioned further to one movable contact portion side than a portion linked to the movable support body 131, and a second set of sliding guides 403 is positioned further to the other movable contact portion side than the portion linked to the movable support body 131.

According to this configuration, it is possible to reliably regulate oscillation in the direction of rotation of the movable contact 132 with the metal sliding guides 403.

(4) The base plate portion 404 is provided to integrally link the end portions on the electromagnet unit 200 side of the plurality of sliding guides 403. By disposing the base plate portion 404 facing the outer surface of the bottom portion on the electromagnet unit 200 side of the insulating cylinder 140, and inserting the sliding guides 403 through the apertures formed in the bottom portion, each of the sliding guides 403 is disposed inside the housing receptacle.

According to this configuration, it is possible to easily create a state wherein the lower end portion sides of the plurality of sliding guides 403 are supported by the insulating cylinder 140.

Also, when attaching the sliding guides 403 to the insulating cylinder 140 too, assembly is easy, as it involves only installing by inserting the sliding guides 403 through the apertures.

(5) The base plate portion 404 is formed of two independent base plate portions 404, a first base plate portion 404 is integrally linked to end portions of the first set of sliding guides 403, and a second base plate portion 404 is integrally linked to end portions of the second set of sliding guides 403.

According to this configuration too, it is possible to easily create a state wherein the lower end portion sides of the plurality of sliding guides 403 are supported by the insulating cylinder 140.

(6) The housing receptacle including the insulating cylinder 140 forms a sealed structure sealing at least the fixed contact portions and movable contact 132.

As heretofore described, it is possible to suppress wear debris and, even in the event that wear debris is generated and infiltrates between contacts, it is possible to avoid conduction failure. As a result of this, it is possible to increase the reliability of opening and closing the current path, even when the contact portions are sealed.

All details of Japanese Patent Application 2012-271280 (application dated Dec. 12, 2012), over which this application claims priority, form one portion of this disclosure by reference.

Herein, a description has been given while referring to a limited number of embodiments but, the scope of the claims is not limited thereto, modifications of each embodiment based on the heretofore described disclosure will be apparent to those skilled in the art.

REFERENCE SIGNS LIST

10 Electromagnetic contactor
100 Contact device
101 Contact mechanism
102 Arc extinguishing chamber
104 Metal rectangular tubular body
105 Fixed contact support insulating substrate
111, 112 Fixed contact
114 Support conductor portion
118 Contact formation portion (fixed contact portion)
130 Movable contact portion
131 Movable support body
132 Movable contact
133 Through hole
134 Contact spring
140 Insulating cylinder
140*a* Rectangular tubular portion
140*b* Bottom plate portion
200 Electromagnet unit
215 Movable iron core
230 Cap
400 Wall portion
401 Opposing wall portion
401*a* Guide portion
403 Sliding guide
404 Base plate portion

What is claimed is:

1. An electromagnetic contactor comprising:

a pair of fixed contact portions disposed to be separated a predetermined distance away from each other;

a movable contact extending in a separating direction of the pair of fixed contact portions, and including a pair of movable contact portions disposed facing the pair of fixed contact portions on two end portion sides thereof;

a shaft shaped movable support body supporting a central portion of the movable contact in an extending direction of the movable contact;

a housing receptacle formed from a non-conductive body, housing at least the pair of fixed contact portions and the movable contact;

an electromagnet unit causing the movable support body to move back and forth to cause the movable contact portions to contact to and separate from the pair of fixed contact portions; and sliding guides extending along a moving direction of the movable contact for moving the movable contact back and forth in the housing receptacle to regulate a turning displacement of the movable contact, wherein the sliding guides are different from the housing receptacle, and each of the sliding guides includes two end portions in an extending direction of the sliding guide formed from a material having spring properties supported by the housing receptacle.

2. The electromagnetic contactor according to claim 1, wherein the sliding guides are made of metal.

3. The electromagnetic contactor according to claim 1, wherein the sliding guides include at least four sliding guides, the four sliding guides form sets of two sliding guides each being disposed sandwiching the movable contact on two sides of the movable contact in a width direction, a first set of sliding guides is positioned between one of the movable contact portions and the movable support body, and a second set of sliding guides is positioned between another of the movable contact portions and the movable support body.

4. The electromagnetic contactor according to claim 3, further comprising:

a base plate portion integrally linking end portions of the sliding guides on an electromagnet unit side, wherein the base plate portion is disposed facing an outer surface side of a bottom portion of the housing receptacle on the electromagnet unit side, and each of the sliding guides is inserted into each of the through apertures formed in the bottom portion respectively so that each of the sliding guides is disposed inside the housing receptacle.

5. The electromagnetic contactor according to claim 4, wherein the base plate portion includes two independent base plate portions, a first base plate portion is integrally linked to end portions of the first set of two sliding guides, and a second base plate portion is integrally linked to end portions of the second set of two sliding guides.

6. The electromagnetic contactor according to claim 1, wherein the housing receptacle includes a sealed structure sealing at least the fixed contact portions and movable contact.

* * * * *